United States Patent [19]

Koine

[11] Patent Number: 4,735,126

[45] Date of Patent: Apr. 5, 1988

[54] CARTRIDGE FEED FOR DOUBLE-BARREL GUN

[75] Inventor: Richard Koine, Ratingen, Fed. Rep. of Germany

[73] Assignee: Rheinmetall GmbH, Duesseldorf, Fed. Rep. of Germany

[21] Appl. No.: 818,544

[22] Filed: Jan. 13, 1986

Related U.S. Application Data

[63] Continuation-in-part of Ser. No. 479,195, Mar. 28, 1983, abandoned.

[30] Foreign Application Priority Data

Mar. 27, 1982 [DE] Fed. Rep. of Germany ..... 3211416

[51] Int. Cl.[4] ..... F41D 10/28; F41D 10/32

[52] U.S. Cl. ..... 89/33.04; 89/33.05; 89/33.25; 89/126

[58] Field of Search ..... 89/1.41, 9, 11, 33.01, 89/33.04, 33.05, 33.1, 33.14, 33.16, 33.17, 33.2, 33.25, 126

[56] References Cited

FOREIGN PATENT DOCUMENTS 16361 of 1893 United Kingdom ..... 89/11

*Primary Examiner*—Stephen C. Bentley

[57] ABSTRACT

A cartridge feeder for a gun having two alternately fired barrels has respective adjacent loading positions. The feeder comprises a guide defining a path having an upstream end and a downstream end, the latter being at one of the positions and the other position being between the downstream and the upstream end. Cartridges are movable in a row along the path and are laterally displaceable out of the path at the positions, so they can be chambered directly from this path. A sprocket at an upstream end of the path is rotated while in engagement with a sequence of cartridges to advance same into the upstream end and thereby push the cartridges along the path into the positions. The feeder can be formed in part by an endless flexible conveyor having a stretch extending along the path opposite the barrels and formed with a succession of cartridge-engaging holders. It can also be closed at its downstream end and provided with a pawl that blocks cartridges from moving backward along the path in the guide from the downstream to the upstream end.

10 Claims, 5 Drawing Sheets

CARTRIDGE FEED FOR DOUBLE-BARREL GUN

CROSS-REFERENCE TO RELATED APPLICATION

This application is a continuation-in-part application of our co-pending application Ser. No. 479,195, filed Mar. 28, 1983, now abandoned entitled CARTRIDGE FEED FOR DOUBLE-BARREL GUN.

BACKGROUND OF THE INVENTION

The present invention relates to a cartridge feeder for a double-barrel gun. More particularly this invention concerns a sprocket type feeder for an artillery piece whose barrels are fired and reloaded alternately.

A standard two-barrel artillery piece fires and reloads the barrels alternately, normally with some sort of recoil slide action serving to eject the spent cartridge and chamber a new shell. The live ammunition is carried normally on belts that are advanced by some sort of sprocket arrangement to position them where they can be loaded by the loading mechanism into the chamber. Obviously the rate of fire of such a gun can be fairly high, so that the shells must be advanced rapidly and accurately positioned for both barrels. The cartridge feed must still be as compact and simple as possible, something not hitherto achieved in a serviceable device.

In addition it is desirable for such a feeder to be opened up so that the entire region confronting the rear ends of the gun barrels can be cleared for all to see when the piece is being moved. In this manner the possibility of an accidental shot is eliminated in a manner that can be seen easily.

OBJECT OF THE INVENTION

It is therefore an object of the present invention to provide an improved cartridge feed.

Another object is the provision of such cartridge feeder which is compact, which operates surely, and which can run at high speed to supply two adjacent barrels that are alternately fired and loaded.

SUMMARY OF THE INVENTION

These objects are attained according to the instant invention in a cartridge feeder for a gun having two alternately firing barrels having respective adjacent loading positions. The feeder comprises a guide defining a path having an upstream end and a downstream end, the latter being at one of the loading positions and the other loading position being between same and the upstream end. Cartridges are movable in a row along the path and are laterally displaceable out of the path at the loading positions, so they can be chambered directly from this path. A sprocket at an upstream end of the path is rotated while in engagement with a sequence of cartridges to advance same into the upstream end and thereby push the cartridges along the path into the loading positions.

This mechanism is extremely compact and simple. Furthermore it can be made to operate smoothly so it will not interfere with aiming the piece.

The drive means according to this invention continuously rotationally drives the sprocket. The guide has an endless flexible conveyor having a stretch extending along the path opposite the barrels and formed with a succession of cartridge-engaging holders, and means supporting the conveyor on the gun for displacement of the stretch from the upstream to the downstream end.

More particularly the conveyor is a chain and has a series of links each provided with a respective holder.

The guide can be closed at its downstream end and can be provided with means for blocking cartridges from moving backward along the path in the guide from the downstream to the upstream end. This blocking means can be a spring-loaded pawl carried on the guide at the downstream end of the path. In addition the guide is provided at each of the positions with a spring-loaded lever urging the cartridge at the respective position toward the respective barrel.

The guide path is closed downward by holder elements at the positions. Thus it is possible for the holder elements and guide to pivot relative to the gun. They can be swung up during transit to make firing of the piece impossible, swinging about an axis parallel to and near or on the sprocket axis.

To feed two different kinds of ammunition the system of this invention can have a second such guide, sprocket, and means at the other side of the loading positions. Both guides are displaceable between positions covering the loading positions and spaced away from the loading positions. Thus these guides can be used alternatively.

Means is provided at the upstream end for separating the cartridges from their cartridge belt. This means can be a loading element movable parallel to the respective barrel. The loading element can be chain mounted or of the straight-line action type.

BRIEF DESCRIPTION OF THE DRAWING

Other objects and advantages will appear in the following description, which taken with the drawings, presents in a non-limiting explanation two embodiments of the invention which are especially adapted to a cartridge feed for a double-barrel gun.

DETAILED DESCRIPTION

Figure 2:
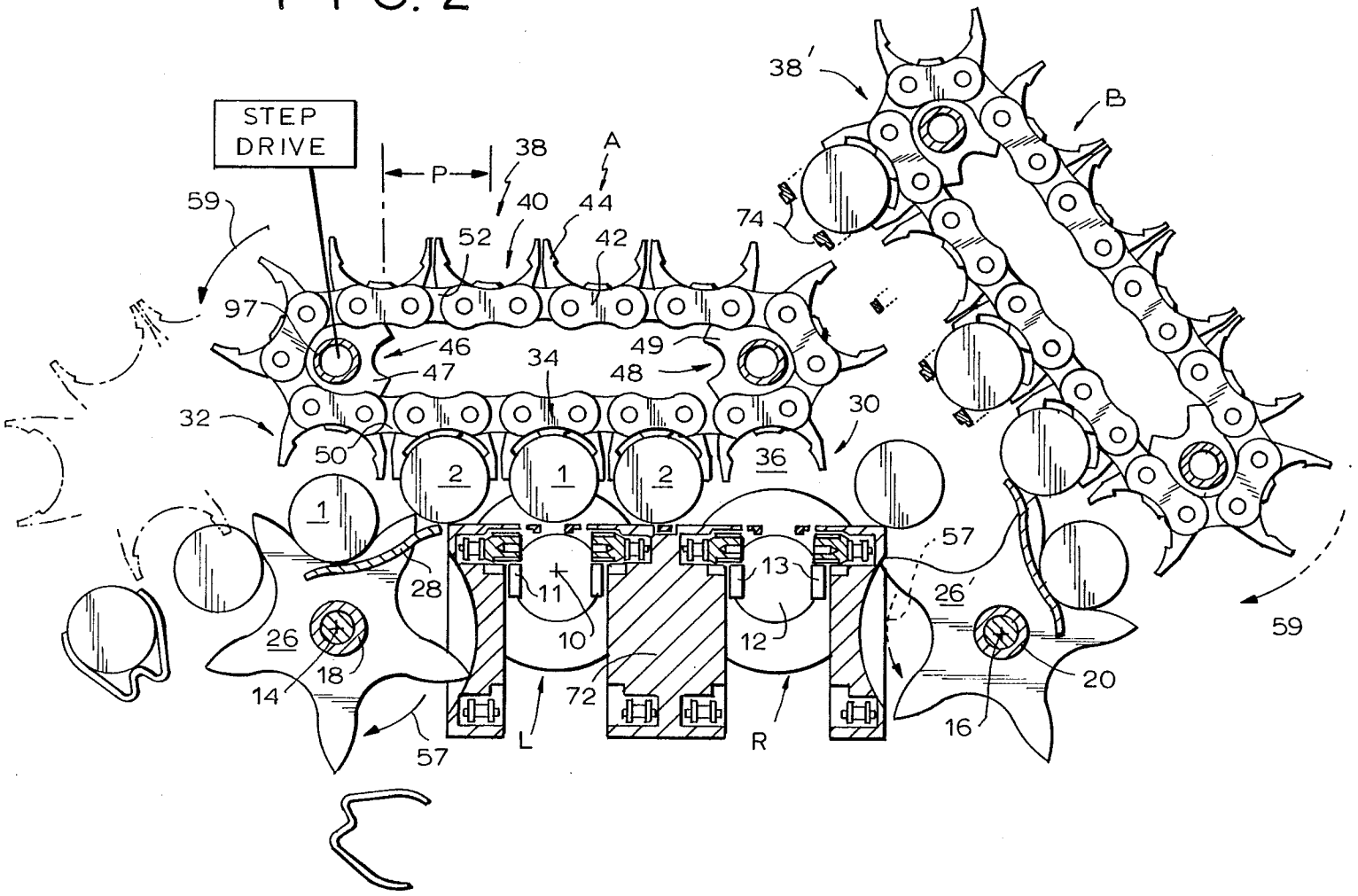
FIG. 2 is a cross-sectional view along line II—II of FIG. 1 illustrating a first embodiment of ammunition guide means in an operative position and ammunition guide means in an inoperative position.
Figure 2A:
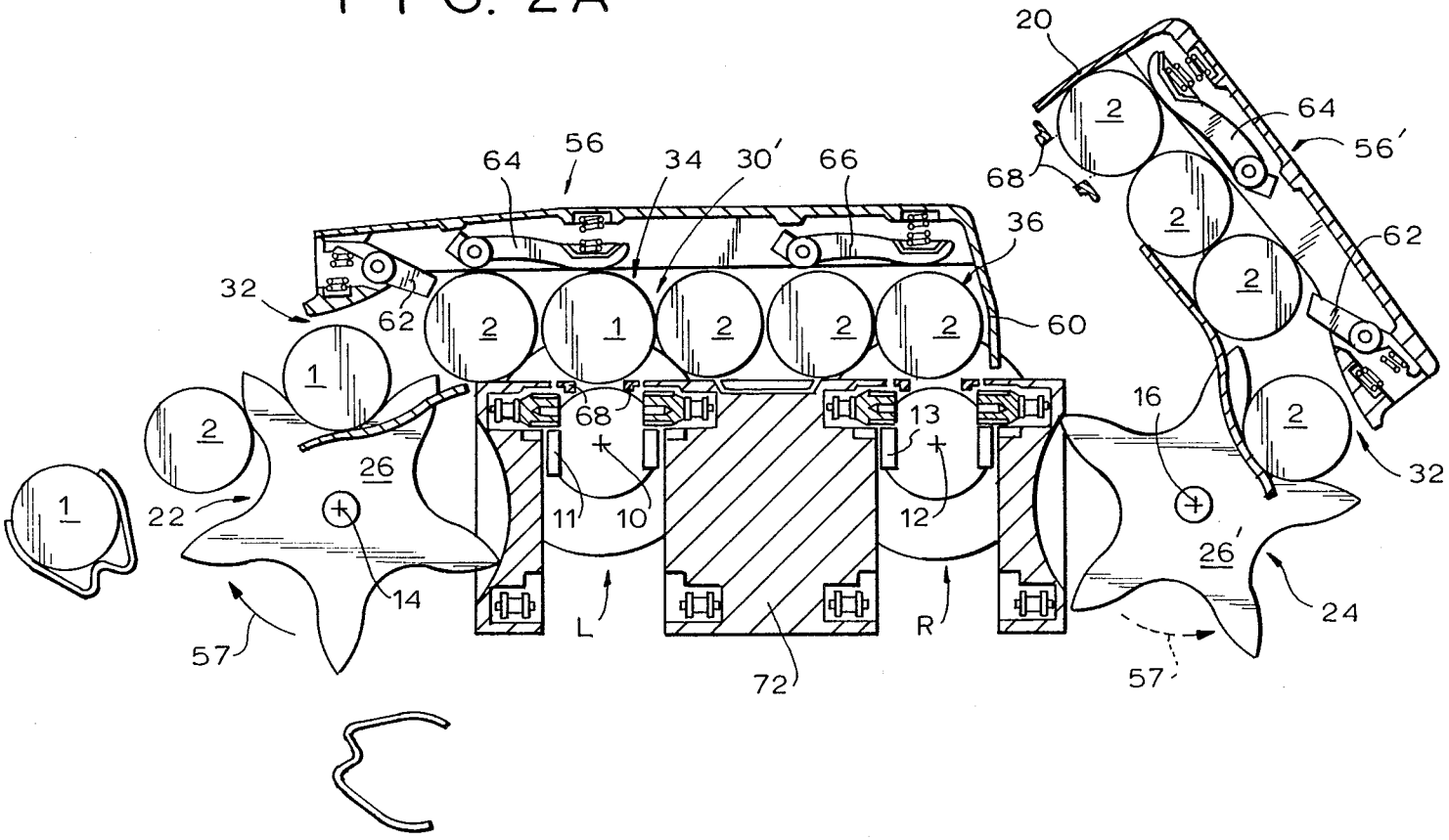
FIG. 2*a* is a cross-sectional view along line II—II of FIG. 1 illustrating a second embodiment of ammunition guide means in operative and inoperative positions.

As seen in FIG. 2 and 2A a gun has a frame 72 provided with right and left barrels R and L. On the left-hand side, as seen from the back in the drawing, the frame 72 is provided with a feeder 18 formed by a pair of sprockets 26 (only one visible in the drawing) rotatable about a common axis 14 parallel to the barrels R and L and coupled to the breech mechanism so as to rotate through an increment each time a shot is fired.

Figure 1:
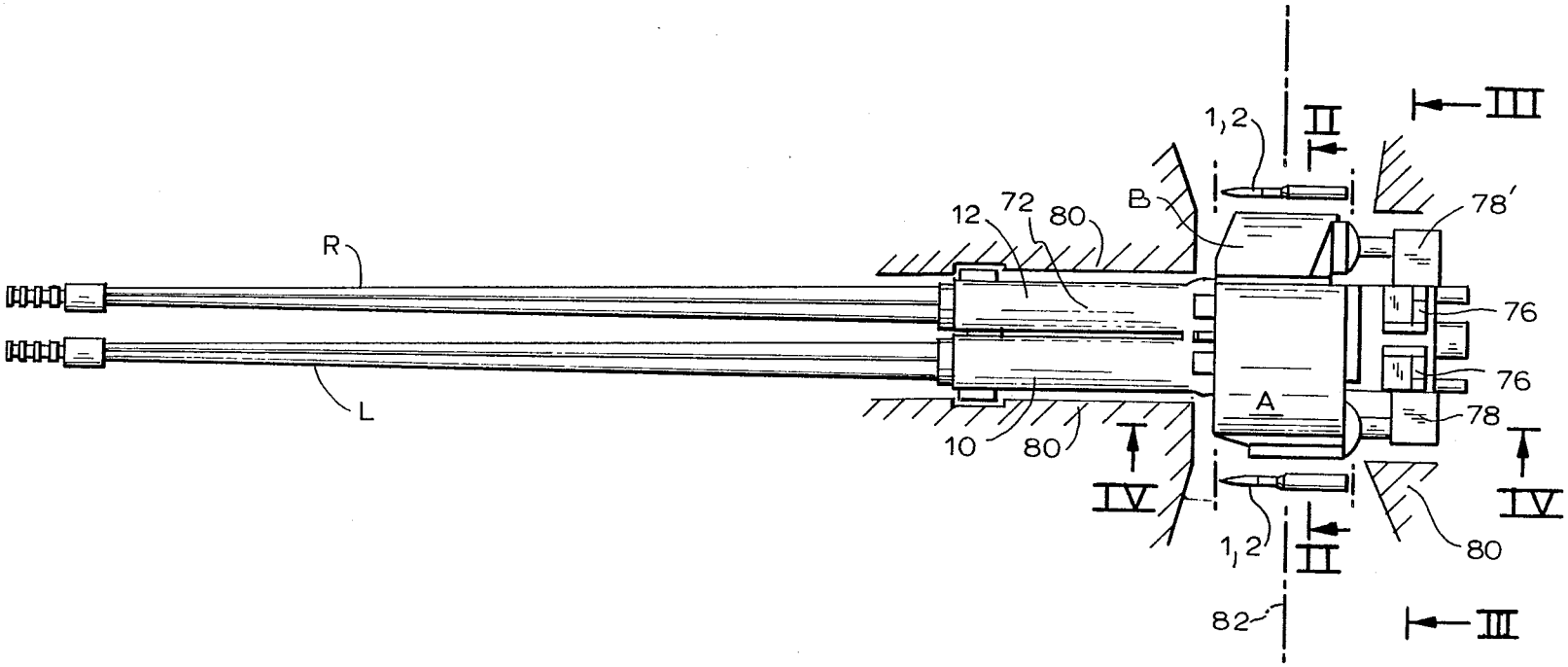
FIG. 1 is a plan view of a double barrel weapon having bilateral mirror-like ammunition feed means.

FIG. 1 illustrates in plan view the arrangement of a double barrel weapon, the left barrel L and right barrel R of which are mounted in a common weapon housing 72 in such a way that they are positively connected to each other. The gun barrel axes 10, 12 of both gun barrels are parallel and fairly closely spaced. The weapon housing 72 is mounted within a cradle 80 (schematically illustrated) and extend therein along the axial direction. When fired the recoil of the gun barrel effects a slidable rearward movement, whereby the cradle 80 for the elevation adjustment of the gun barrel L, R is furthermore pivotally adjustable about a trunnion bearing axis 82 (illustrated in dot dash lines in FIG. 1).

A belt stripper 28 is provided to free cartridges 1, 2 from their support belt, although the cartridges 1, 2 could also be fed in from a hopper or via a closed chute, that is without a belt if desired. A positioning path 30 extends from an inlet end 32 at the sprocket wheel 26 past a loading position 34 for the cartridges 1 into the barrel L and up to a loading position 36 for the cartridges 2 into the barrel R.

The top of the positioning path 30 is defined by an endless conveyor chain 38 each of whose links 42 is provided with holding fingers 44 defining respective seats 40 that fit around the shells 1, 2. This chain 42 is spanned over upstream and downstream sprockets 46 and 48 rotatable about axes parallel to the axis 14 and spaced apart by a distance which is equal to a whole-number multiple of the pitch P of the chain 38, which pitch P is equal exactly to twice the distance between the axes 10 and 12 of the barrels L and R.

The sprockets 26 are continuously urged into clockwise rotation as shown at 57 in FIG. 2 and during firing, as the cartridges are used, the chain conveyor 38 moves in the direction 59 to bring a succession of the cartridges 1, 2 into position for charging by loading elements 11 and 13, here of the chain type, into the chambers of the barrels R and L. Even though the feeder according to this invention is mounted on the frame or breech housing, it will not jar the carrying structure and cause a missed shot since it operates smoothly and continuously. This continuous rotation is transformed into an intermittent advance of the cartridges along the path 30 via a step drive, but the steps are made during reloading and/or immediately after firing when the lateral feed motion can no longer affect the shot.

The path 30 is delimited at its lower side by a plurality of holding elements 74 positioned under the downwardly open seats 40 of the chain 38. Thus the feeder can be swung back off the breech mechanism for maximum safety during transport of the artillery piece, giving a clear visual indication that the piece is out of action even though the belt is left in the feeder.

In addition as shown to the right in FIG. 2 a second feeder having conveyor chain 38′ which rotates in the direction 59 is provided adjacent sprockets 26′ rotatable about an axis 16 at the opposite end of the path 30 and parallel to the axes 10, 12, and 14. When the left-hand double feeder is in the pivoted-up position shown in dotdash lines, the other feeder constituted by the conveyor 38′ and sprocket 26′ can be pivoted down to feed different ammunition in from the opposite side of the dual breech. The sprocket 26′ rotates in the direction 57 to bring in the shells in the same manner described above for the chain 38 and sprocket 26.

Ammunition feed of the ammunition units 1, 2 is effected by providing on each side of the weapon housing 72 a swingable inlet-ammunition-transport arrangement A, B which is adapted to be swung from an operative to an inoperative position, thereby selectively effecting the ammunition transport for both barrels L, R. For example, while the transport arrangement B is in an inoperative position, the transport arrangement A is in an operative position and is therefore capable to move the ammunition units 1, 2 into a delivery position 34 for the left gun barrel L and into a delivery position 36 for the right gun barrel R (FIG. 2). The transport arrangements A, B are adapted to be operatively connected with a step drive formed by a cam gear drive 78, 78′, whereby the transport arrangement A or B is stepwise driven by hydraulic static motors 76 which are supplied by an external source of energy.

Figure 3:
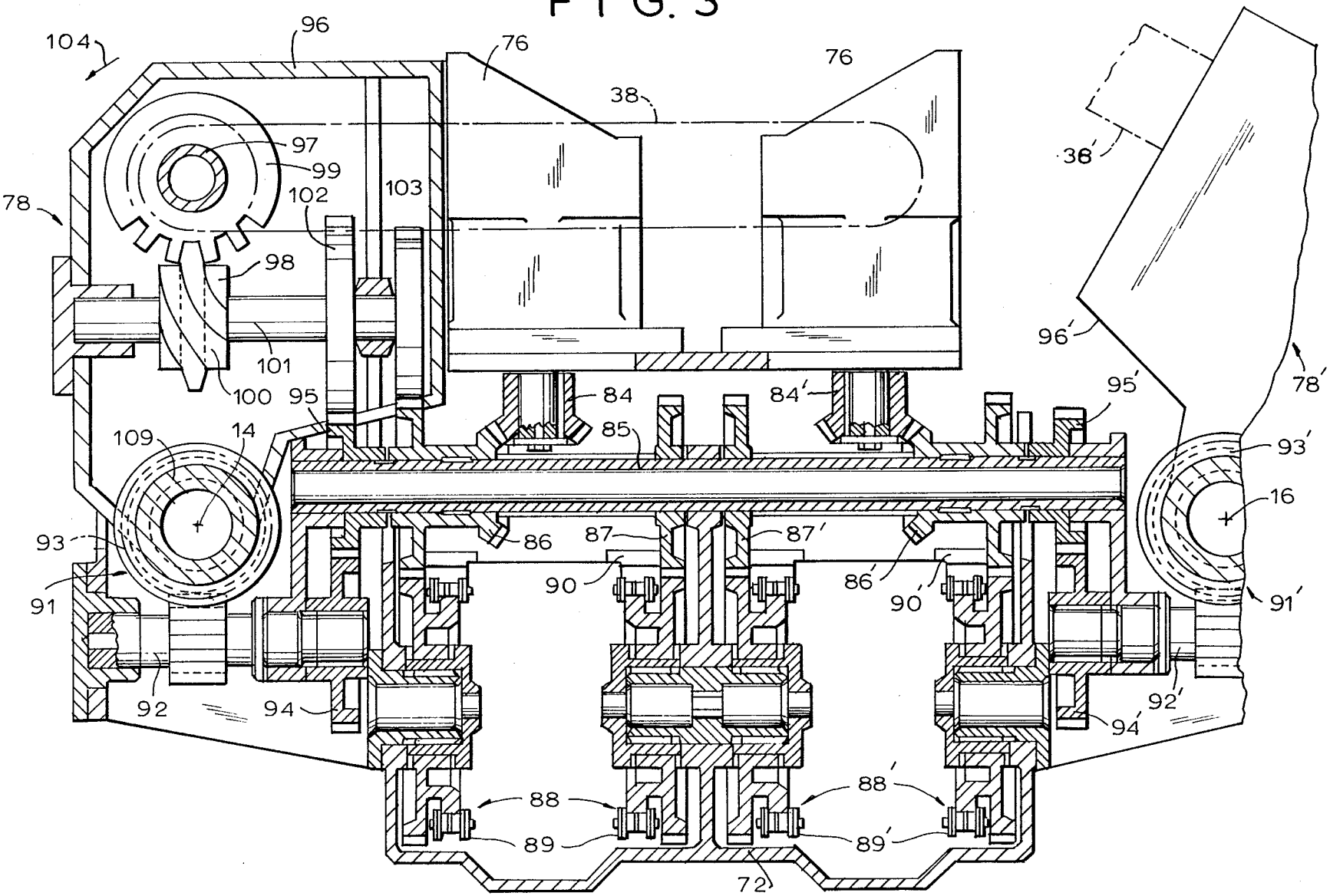
FIG. 3 is a cross-sectional view along line III—III of FIG. 1 illustrating a spur gear—cam gear drive for a step drive of a transport arrangement for the ammunition feed means and a continuous drive of a control shaft.
Figure 4:
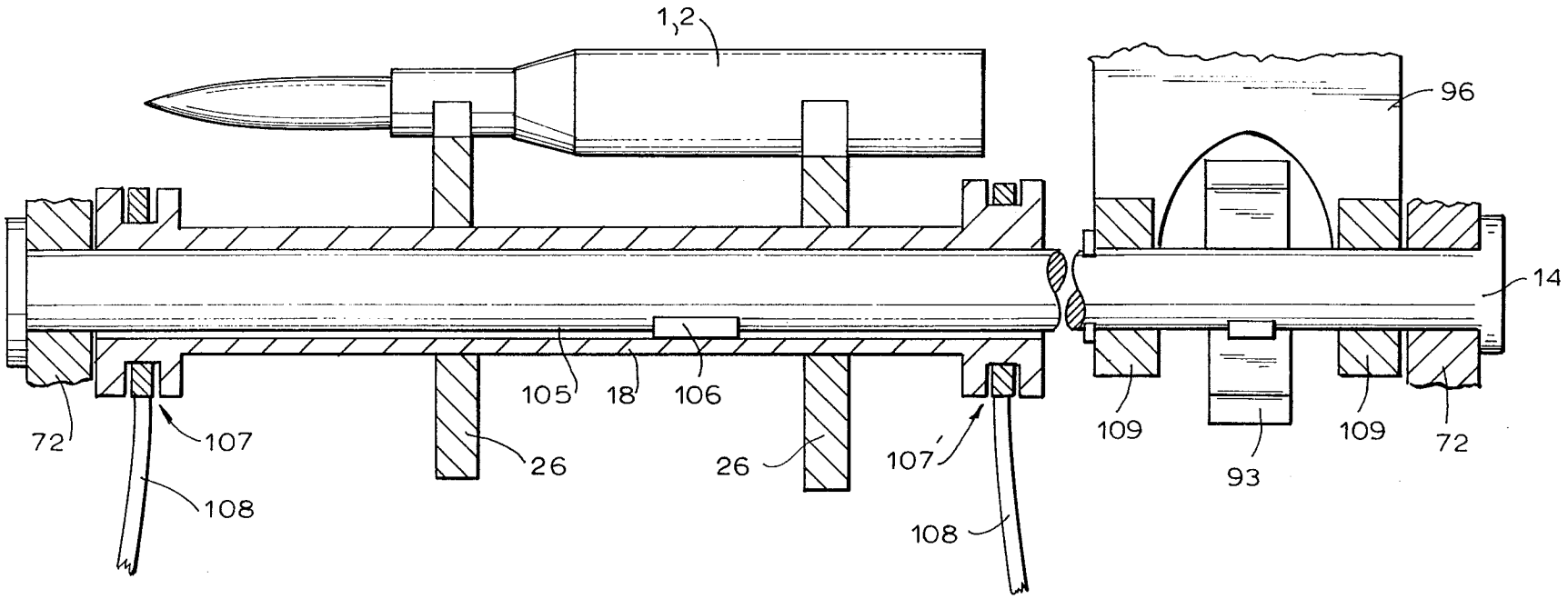
FIG. 4 is a longitudinal sectional view along line IV—IV in FIG. 1 which illustrates the star wheel shaft extending in an axial direction and rigidly secured to the cradle of the weapon.

A debelting mechanism 28 is provided for each star wheel 26. The debelter 26, which is not illustrated in detail, provides with its fixed end a positioning path 30. This positioning path 30 has an inlet region 32 and is limited on its upper side by means of the transport arrangements A or B. Each one of these transport arrangements is formed by means of a transport chain which has a plurality of equi-distantly arranged transport members 40 mounted thereon. These transport members 40 are mounted on chain link members which are moved around the chain wheels 47, 49 so that the sprockets 46, 47 extend into the chain link member 42 as the chain moves around the chain wheels 47, 49. Each transport element 40 has a pair of projections forming a fork-like holding member 44. The transport element 40 moves operatively in the direction of the arrow 59, whereas the star wheel shaft rotates in the direction of the arrow 57. The transport element structure 38 of the transport element 40 is fixedly mounted on the weapon (FIGS. 3 and 4). A rigid mounting on the cradle is also possible in a non-illustrated manner, whereby such an arrangement is determined in connection with the demands placed on the ammunition feed systems.

The star wheel shaft 18 is continuously driven by a drive mechanism as illustrated in FIG. 3. A corresponding debelted ammunition unit 1, 2 is transferred from a transport pocket of the star wheel shaft 18, not illustrated in detail, to the next following holding fork 44 and is stepwise transversely to the gun barrel axes 10 and 12 transported into the corresponding delivery position 34, respectively 36. The distance between gun barrel axes 10 and 12 must be a multiple of a complete number of the divisions of the holders 44. Only in this fashion is it possible that the corresponding ammunition unit 1, respectively 2, is positioned for entrainment by a corresponding not further illustrated loader 90 (FIGS. 3 and 4). The transport element 40 is stepwise driven in cadence with the total cadence of both gun barrels L and R. The stepwise movement can advantageously be effected by means of a cam step drive 78 (FIG. 3) or by means of a non-illustrated mechanism that is energized by the recoil of the respective firing gun barrel or also by means of the straight pull breech block.

The transportation element structure 38, 38′ can in an advantageous manner be swung about an axis 14, 16, as is illustrated in the right halves of FIGS. 2 and 3 in order for the ammunition units 1, respectively 2, which are mounted in the corresponding holders 44, do not detach themselves under the influence of bumping during travel or other impacts from the holders 44, there are arranged as illustrated schematically support element 74 below a border plan of the positioning path 30, which support elements 74 are connected to the transport element structure 38. By means of a substantial mirror-like arrangement of a star wheel shaft 18, respectively 20, and a transport element structure 38 coacting therewith and further by means of the previously described swingability of the latter, it is possible in a simple manner to fire different types of ammunition.

The arrangement of FIG. 2A is substantially identical to that of FIG. 2, with reference numeral identical to those of FIG. 2 associated with identical structure. The intake feeder 22 here is formed by sprockets 26, but the belt conveyor 38 is replaced by a rigid housing 56 provided at the intake end 32 with a spring-loaded antireturn pawl 62 and having a downstream end defined by a wall 60. Above the barrels L and R are respective spring-loaded levers 64 and 66 that press the respective shells 1 and 2 down toward them, and that also hold the shells against respective holder elements 68 that, like the elements 74 of FIG. 2, are fixed relative to the housing 56. The sprockets 26 push the cartridges 1 and 2 on the path 30' into direct contact with one another, so the distance between the two axes 10 and 12 is equal to a whole-number multiple of the cartridge diameter.

This system has a second single-barrel feeder 24 with a short housing 56'. As in FIG. 2 the drives for the opposite sprockets 26 and 26' are alternative and automatic, that is when the feeder is tipped up its drive stops. Such systems can be applied to sliding and/or straightline breech mechanisms.

FIG. 3 illustrates the manner of operation of the stepwise moving transport element 38 when in an operative position, on the one hand, and on the other hand, the manner of operation of the continuous rotational movement being carried out by the star wheel shaft 18 (FIGS. 2, 4). The hydrostatic motors 76 drive via a corresponding gear tooth wheel 84, 84' a corresponding gear tooth wheel 86, 86' mounted about a central shaft 85 and rigidly connected thereto, which meshes on one side with the bevel gear wheel 84, 84' and has a straight gear ring on the other side. The central shaft 85 is transversely arranged with respect to the gun barrel axis 11, 12. It includes in its middle region again two rigidly connected spur gear wheels 87, 87'. Underneath the gear wheel shaft 85 there is mounted within the housing 72 for each gun barrel L, R a breech block drive 88, 88'. Each breech block drive consists of a pair of parallel chains 89, 89' which move adjacent to each other in the gun barrel axis direction, whereby the chain 89 is driven via their two pertaining chain wheels by the gear wheels 86 and 87 and the chain 89' via thereto pertaining chain wheels by the gear wheels 86' and 87. Each breech block drive is operatively connected with a not further illustrated loader 90, 90', whereby for an alternating drive of both gun barrels L, R the non-illustrated breeches and the loader are operating in a cycle that is offset by an angle of 180 degrees with respect to each other. In the corresponding lateral outer region of the housing 72 there is provided for each star wheel shaft 18, 20 (FIGS. 2, 4) a worm gear drive 91, 91', whereby the corresponding worm gear shaft 92, 92' is arranged parallel to the central shaft 85 and the corresponding worm gear wheel 93, 93' is mounted on an axis 14, 16 which is disposed within the star wheel shaft 18, 20 (FIG. 4) and is fixed to the weapon. The gear wheel 94, 94' is connected to each worm gear shaft 92, 92' in a rigid manner and confronts the inside of the housing and is firmly meshed with a further intermediate wheel 95, 95' mounted on the central shaft 85.

The cam drive 78, 78' arranged above the worm gear drive 91, 91' consists within a corresponding housing 96, 96' of a drive shaft 97 which is firmly joined with the chain wheel 47 of the transport element structure 38 (FIG. 2), which is stepwise driven via a toothed wheel 99 that engages in a cam wheel 98. The cam 100 of the cam wheel 98 is constructed in such a way that at all times one tooth of the gear wheel 99 is only further rotated in a partial region of the rotation of the cam wheel, so that a stepwise adaption of the firing cycle to the transport movement of the transport element structure 38 (FIG. 2) results. The cam wheel 98 is joined within the housing 96 via a shaft 101 with two spur gear wheels 102, 103, whereby the spur wheel gear 102 is joined in the operative position of the transportation element structure 38 with the intermediate wheel 95 and the gear wheel 103 with the gear wheel 86 of the central shaft 85. By means of this formlocking connection with the central shaft 85 there is provided in the operative position of the transportation element structure 38 a positive forced continuous rotational movement of the star wheel shaft 18 and a stepwise transport movement of the transportation element structure 38.

The housing 96 of the cam drive 78 is, as is clearly illustrated in FIG. 4, swingably mounted on the shaft 14 which is fixed with respect to the housing of the weapon. It is thereby possible to swing the transport element structure 38 and the housing 96 from the operative position in the direction of the arrow 104 into the inoperative position, in which for example the housing 96' is disposed. The transport element structure 38, 38' is thereby joined in a non-illustrated manner via the bearing of the chain wheel 47, 49 with the housing 96 of the cam drive 78.

FIG. 4 illustrates in detail the weapon housing fixed mounting of the shaft 14 and the mounting of the star wheel shaft 18 which is fixedly mounted relative to the cradle in the axial direction. The shaft 14 which is mounted in the weapon housing 72 and is driven by means of the worm gear wheel 93 is formlockingly joined with the star wheel shaft 18 via a wedge 106 that engages into a grove 105 of the star wheel shaft 18. The grove 105 and the wedge 106 furnish a longitudinal slidability of the shaft 14 within the star wheel shaft 18, so that the star wheel shaft can be secured on both sides into the ring-shaped slidable mounting 107, 107' at the cradle, whereby a participation of the star wheel shaft 18 in the axial movement of the to and fro moving weapon part is prevented. The slide-bearings 107, 107' can advantageously be directly joined to the cradle-fixed channel inlet 108, whereby the to be transported ammunition units 1, 2 are to be guided via the star wheel shaft 26 into the inlet region 32 (FIG. 2) of the positioning path 30 (FIG. 2).

The housing 96 of the cam drive 78 is mounted on the shaft 14 so as to be laterally fixed by the slide-bearings 109 on both sides of the worm gear wheel 93.

The embodiment is based on the operative principle that the ammunition units 1, 2 of the corresponding star wheel shaft are fed in a belted condition and that in the corresponding inlet region 32 (FIG. 2) are separated from the belt members. In an advantageous manner the embodiment can also be used with unbelted feeding of the ammunition units into the corresponding inlet regions. For this purpose the corresponding inlet region 32 can be provided with a non-illustrated single shaft, which is comparable to a magazine.

In an advantageous manner the invention can be used with automatic weapons having a straight pull breech block as a loader (not illustrated) as well as with automatic weapons having wedge breech blocks, in which case there must be arranged a loader 90 on each side on the running chain 89 (FIG. 3).

A further advantage results from the simultaneous demounting of the corresponding structure in an inoperative position, so that with respect to the presence of ammunition in the weapon a good overall view and as high a safety as possible against unintentional firing is furnished.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. A dual-barrel cartridge feeder for a gun having two alternately fired barrels having respective adjacent loading positions, the feeder comprising;

a guide defining a path having an upstream end and a downstream end, the downstream end being at one of the positions and the other position being between same and the upstream end, cartridges being movable in a row along the path and being laterally displaceable out of the path at the positions;

a sprocket at an upstream end of the path; and means for rotating the sprocket while same is engaging a sequence of cartridges to advance same into the upstream end and thereby push the cartridges along the path into the positions; including drive means operatively connected to the sprocket for continuously rotationally driving the sprocket, the guide including an endless flexible conveyor having a stretch extending along the path opposite the barrels and formed with a succession of cartridge-engaging holders; and means supporting the conveyor on the gun for displacement of the stretch from the upstream to the downstream end.

2. The dual-barrel cartridge feeder defined in claim 1, wherein the conveyor is a chain and has a series of links each provided with a respective such holder.

3. The dual-barrel cartridge feeder defined in claim 1, wherein the guide is provided with holder elements at the positions.

4. The dual-barrel cartridge feeder defined in claim 6, wherein the holder elements and guide are pivotal relative to the gun.

5. The dual-barrel cartridge feeder defined in claim 7, wherein the sprocket is rotatable about a sprocket axis parallel to the barrels and the guide and elements are pivotal on the gun about an axis near this pivot axis.

6. The dual-barrel cartridge feeder defined in claim 1, further comprising a second such guide, sprocket, and means to the other side of the position both guides being displaceable between positions covering the positions and positions spaced away from the positions, whereby the guides can be used alternately.

7. The dual-barrel cartridge feeder defined in claim 1, wherein said cartridges are mounted on a belt which is being fed into said upstream end, and further comprising means at the upstream end for separating the cartridges from their cartridge belt.

8. The dual-barrel cartridge feeder defined in claim 1, wherein the gun is provided at each of the positions with a loading element movable parallel to the respective barrel.

9. The dual-barrel cartridge feeder defined in claim 11, wherein the loading element is of the chain-mounted type.

10. In an improved dual-barrel cartridge feeder for feeding cartridges to two cradled gun barrels, said feeder having at least one sprocket wheel rotatably mounted on an axis which is parallel to the gun barrels and fixed relative to the cradle of the gun barrels and a feeder comprising an endless chain and including a succession of cartridge-engaging holders which feeder advances stepwise in a direction transverse to a longitudinal axis of the gun barrels to transport the cartridges to two adjacent loading positions disposed in a common housing of the weapon, axes of the feeder being parallel to the axis of said sprocket, the improvement comprising (a) said feeder comprising an endless chain and a pair of turn around regions and said feeder being operatively mounted above both loading positions and extending along a positioning path, said cartridge engaging holders being mounted on said endless chain and forming the upper boundary of said positioning path between said turn around regions;

(b) said sprocket wheel being arranged at an inlet of said feeder, said feeder being pivotally movable from an operative to an inoperative position and vice-versa about an axis which is parallel to the axis of said sprocket wheel, said feeder and said sprocket wheel being positively operatively connected in such a way that when said feeder is in said inoperative position the stepwise advance of said feeder for transporting cartridges and the rotation of the sprocket wheel for entraining a cartridge belt are interrupted.

* * * * *